United States Patent [19]

Shioiri et al.

[11] Patent Number: 4,992,918

[45] Date of Patent: Feb. 12, 1991

[54] ILLUMINATOR HAVING AN EASILY REPLACEABLE LIGHT SOURCE UNIT

[75] Inventors: Shigeo Shioiri, Chiba; Makoto Tateyama, Saitama; Youichi Akaishi, Tokyo, all of Japan

[73] Assignee: Somar Corporation, Tokyo, Japan

[21] Appl. No.: 301,552

[22] Filed: Jan. 26, 1989

[30] Foreign Application Priority Data

Jan. 26, 1988 [JP] Japan ..... 63-14939
Apr. 25, 1988 [JP] Japan ..... 63-101910

[51] Int. Cl.[5] ..... F21V 19/00

[52] U.S. Cl. ..... 362/368; 362/372; 362/374; 362/226

[58] Field of Search ..... 362/226, 263, 261, 372, 362/374, 375, 368, 804, 285, 362

[56] References Cited

U.S. PATENT DOCUMENTS

| | | | |
|---|---|---|---|
| 2,341,431 | 2/1944 | Fairbanks | 362/372 |
| 4,232,359 | 11/1980 | Leon et al. | 362/268 |
| 4,437,142 | 3/1984 | Donato et al. | 362/347 |
| 4,488,205 | 12/1984 | Quiogue | 362/223 |
| 4,538,217 | 8/1985 | Ewing et al. | 362/372 |
| 4,692,844 | 9/1987 | Gaelerne | 362/372 |
| 4,703,404 | 10/1987 | Helton, III et al. | 362/294 |
| 4,755,920 | 7/1988 | Tinley | 362/374 |
| 4,760,507 | 7/1988 | Ceske et al. | 362/250 |
| 4,839,783 | 6/1989 | Aroi | 362/374 |

FOREIGN PATENT DOCUMENTS

| | | |
|---|---|---|
| 8801145 | 4/1988 | Fed. Rep. of Germany . |
| 2215578 | 8/1974 | France . |

*Primary Examiner*—Stephen F. Husar
*Assistant Examiner*—D. M. Cox
*Attorney, Agent, or Firm*—Sughrue, Mion, Zinn, Macpeak & Seas

[57] ABSTRACT

An illuminator includes an illuminator frame having a cut-out portion in which a light source unit is removably positioned. The light source unit includes a cold-lamp light source supported in a plate-like member of the unit's frame. The plate-like member has extended portions which are also plate-like for fitting into guide slits formed in a light source unit supporting member of the illuminator. The supporting member has a retainer which helps hold the plate-like extensions of the plate-like member of the light source unit. The illuminator includes a power supply linked with a connector positioned so that when the light support unit is inserted into the illuminator in its proper position, a connector provided on the light source unit will connect the light source to the power supply. Thus, the light source unit can be removed from or inserted into the illuminator in a single step process.

17 Claims, 6 Drawing Sheets

ILLUMINATOR HAVING AN EASILY REPLACEABLE LIGHT SOURCE UNIT

BACKGROUND OF THE INVENTION

The present invention relates to an illuminator, particularly to a portable illuminator for use in conjunction with a photographic camera or a video camera.

In the medical field, a picture of a surgical operation is taken by a photographic camera or a video camera for research. A conventional illuminator is used to project light of appropriate luminance, form and color temperature to take the picture. It is desirable to make the illuminator so compact, light and portable that it is easy to position so as to illuminate the affected part of the patient undergoing the operation. The light source of the illuminator is a cold light source which does not make the patient feel uncomfortable due to hot rays of light or does not dry the illuminated area. For example, a metal vapor lamp hermetically containing a rare-earth metal halide is used as the cold light source. The light source of the illuminator is built in the body thereof.

When the lamp filament of the above-mentioned conventional illuminator ceases to function, or the luminance, form or color temperature of the light from the illuminator is inappropriate for the affected part of the patient, the illuminator needs to be disassembled to replace the light source built therein. Thus, replacement of the light source of the illuminator is troublesome.

SUMMARY OF THE INVENTION

The present invention was made in order to simplify the replacement process.

Accordingly, it is an object of the present invention to provide an illuminator in which it is easy to replace the light source.

In an illuminator which has a light source unit and is an exemplary embodiment of the present invention, the body of the illuminator is provided with a unit support for removably fitting the light source unit, and the light source unit is provided with supported unit portions which are supported by the unit support.

Since the light source unit can be attached to and detached from the body of the illuminator in a one-step process, it is easy to replace the light source unit.

Other objects, features and advantages of the present invention will be apparent from the description herein and the drawings attached hereto.

BRIEF DESCRIPTION OF THE DRAWINGS

The above features, advantages and objects of the invention as well as other features, advantages and objects of the invention, will be apparent upon reading the detailed description set forth below, in conjunction with the drawings in which.

DETAILED DESCRIPTION OF THE PREFERRED EMBODIMENTS

Figure 1:
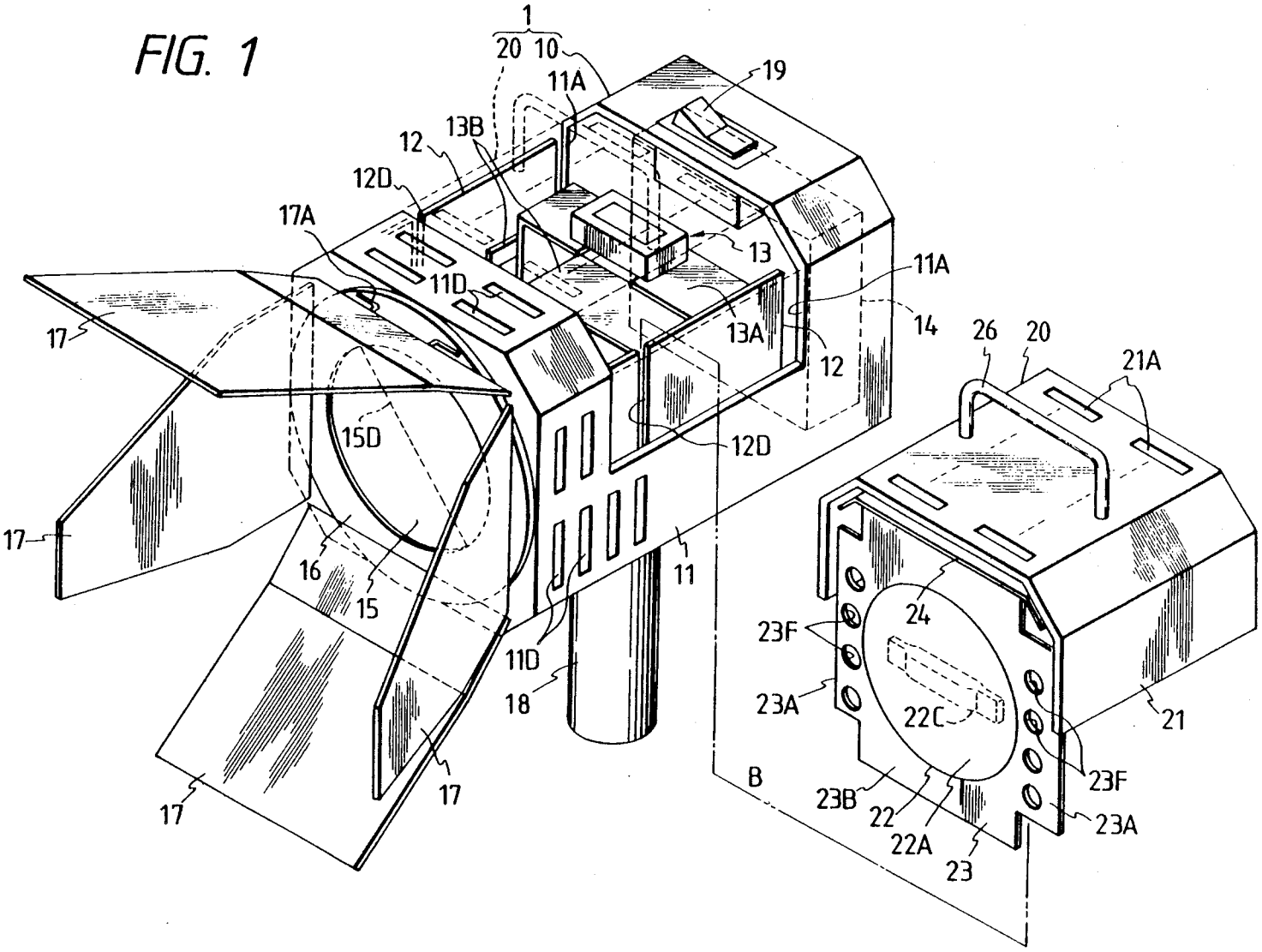
FIG. 1 is a perspective view of an illuminator which is an embodiment of the present invention.

Embodiments of the present invention, which are of the single-lamp illuminator type, are hereafter described with reference to the drawings attached hereto. Like parts are denoted by like reference numerals in the drawings, and will only be described once for brevity.

A first embodiment will now be described with reference to FIGS. 1 and 2.

FIG. 1 shows a perspective view of the illuminator 1 having a light source unit 20 removed therefrom. FIG. 2 shows a sectional view of the illuminator 1 in the state of being fitted with the light source unit 20. As shown in FIGS. 1 and 2, the illuminator 1 has a body 10 and the light source unit 20 removably fitted therein. The illuminator 1 is a single lamp type and is used for illuminating an object or scene to be photographed by a photographic camera or a video camera or the like for medical, biological or other applications. The body 10 of the illuminator 1 is mainly composed of a frame 11, a unit support 12, a power supply connector 13 shaped as a socket, a heat radiator 14, a heat absorption filter 15, a light blocking plate mounting frame 16, light blocking plates 17, a handle 18, and a power supply switch 19.

The frame 11 is shaped as an octagonal prism and made of a material such as aluminum or an aluminum alloy, which has an appropriate hardness and is light and heat-resistant. However, the frame 11 may be made of a synthetic resin to achieve an even lighter structure. The upper central portion of the frame 11 has an opening 11A in which the light source unit 20 is removably fitted. The front of the frame 11 has a light projection opening 11B through which light from a light source 22 is projected. The opening 11B is shaped as a circle but can be formed in any desired shape.

The support 12 is centered inside the frame 11, and is U-shaped along the bottom and both sides of the inside surface of the frame. The support 12 is secured with spacers 12A to the bottom of the inside surface of the frame 11 by screws 12B and 12C. The support 12 is provided with unit guide slits 12D and a retainer 12E, as shown in FIGS. 1 and 2, so that the light source unit 20 is removably fitted in the body 10 of the illuminator 1 and held therein. The guide slits 12D are provided in both sides of the unit support 12. Supported unit portions 23A integrally provided at both side edges of a light source support frame 23 are inserted into the guide slits 12D so that the light source unit 20 is guided by the slits when the unit is fitted in the illuminator body 10. As shown in FIG. 2, the retainer 12E is secured to the bottom of the unit support 12 by screws 12F. The retainer 12E is made of an elastic material such as a metal and a resin. The retainer 12E acts so that a supported unit portion 23B integrally provided at the lower edge of the light source support frame 23 and/or the supported unit portion 23A are pushed by an appropriate force to keep the support frame 23 in contact with the internal surfaces of the unit support 12 along the guide slits 12D. The light source unit 20 is thus held in the body 10 by the retainer 12E.

The unit support 12 is made of a material, such as aluminum or an aluminum alloy, which has an appropriate hardness and is light and heat-resistant. However, the unit support 12 may be made of a synthetic resin to further decrease its weight. The unit support 12 is fitted with the power supply connector 13 near the rear of the frame 11. Supports 13A and 13B are interposed between the power supply connector 13 and the unit support 12 so that the connector is held by the inside surface of the unit support. The supports 13A and 13B are made of the same material as the unit support 12, for example. The power supply connector 13 is coupled to a power supply cord (not shown in the drawings) through the power supply switch 19 provided at the upper portion of the frame 11.

The heat radiator 14 is provided at the rear of the frame 11 so that heat generated by the light source 22 in the illuminator body 10 is transferred out of the illuminator body. The heat radiator 14 includes a motor 14B attached to the rear of the frame 11 by a frame 14A, and a fan 14C mounted on the rotary shaft of the motor. The motor 14B is directly connected to the power supply cord. The rear of the frame 11 is provided with a heat radiation opening 11C and a protective reticulate member 14D which is for preventing the operator of the illuminator from being injured by the rotating fan 14C. The protective reticulate member 14D is made of a metal or a resin, for example.

The heat absorption filter 15 is provided between the light projection opening 11B of the frame 11 and the light source 22 of the unit 20 fitted in the frame 11. The filter 15 is made of a transparent glass or resin to absorb infrared rays from the light emitted from the light source 22. The filter 15 is shaped as a circle but can have any shape. Although the filter 15 may be made of a single plate, it is made of two plates in this embodiment so that a clearance is defined between the two plates, as shown by a dotted line 15D in FIG. 1. The clearance is provided to prevent the filter from cracking due to thermal expansion occurring over long-time use. A frame 15A is interposed between the peripheral portion of the filter 15 and attaching members 15B so that the filter is attached to the inside or outside of the frame 11 by screws 15C.

The light blocking plates 17, which number four in this embodiment but more or less can be used, are attached to the front of the frame 11 by the light blocking plate mounting frame 16. The mounting frame 16 has a central opening through which light emitted from the light source 22 is transmitted. The mounting frame 16 is mounted with spacers 16A on the frame 11 by screws 16B and 16C. The plates 17 are attached with interposed rotary members 17A in four positions to the mounting frame 16. The rotary members 17A can be rotated independently of each other as shown by arrows A in FIG. 2. The plates 17 function to control the divergence of the light emitted from the source 22 or control the form of the light projected from the illuminator 1. The plates 17 are made of a metal such as aluminum, an aluminum alloy and steel, a light-weight resin or the like. The surfaces of the plates 17 are painted black to reduce diffused reflection of the light thereon and absorb heat thereof.

A handle 18 is provided on the bottom of the frame 11 to support the illuminator 1 so that the operator can hold the illuminator by hand or attach the illuminator to a tripod or a mounting jig. The handle 18 is attached to the bottom of the frame 11 by a securing mechanism (not shown in the drawings) such as a screw. The handle 18 is shaped as a shaft in this embodiment.

A plurality of heat radiation openings 11D are provided in the frame 11 so that heat generated by the light source 22 is transferred out of the illuminator body 10 through the openings.

Figure 2:
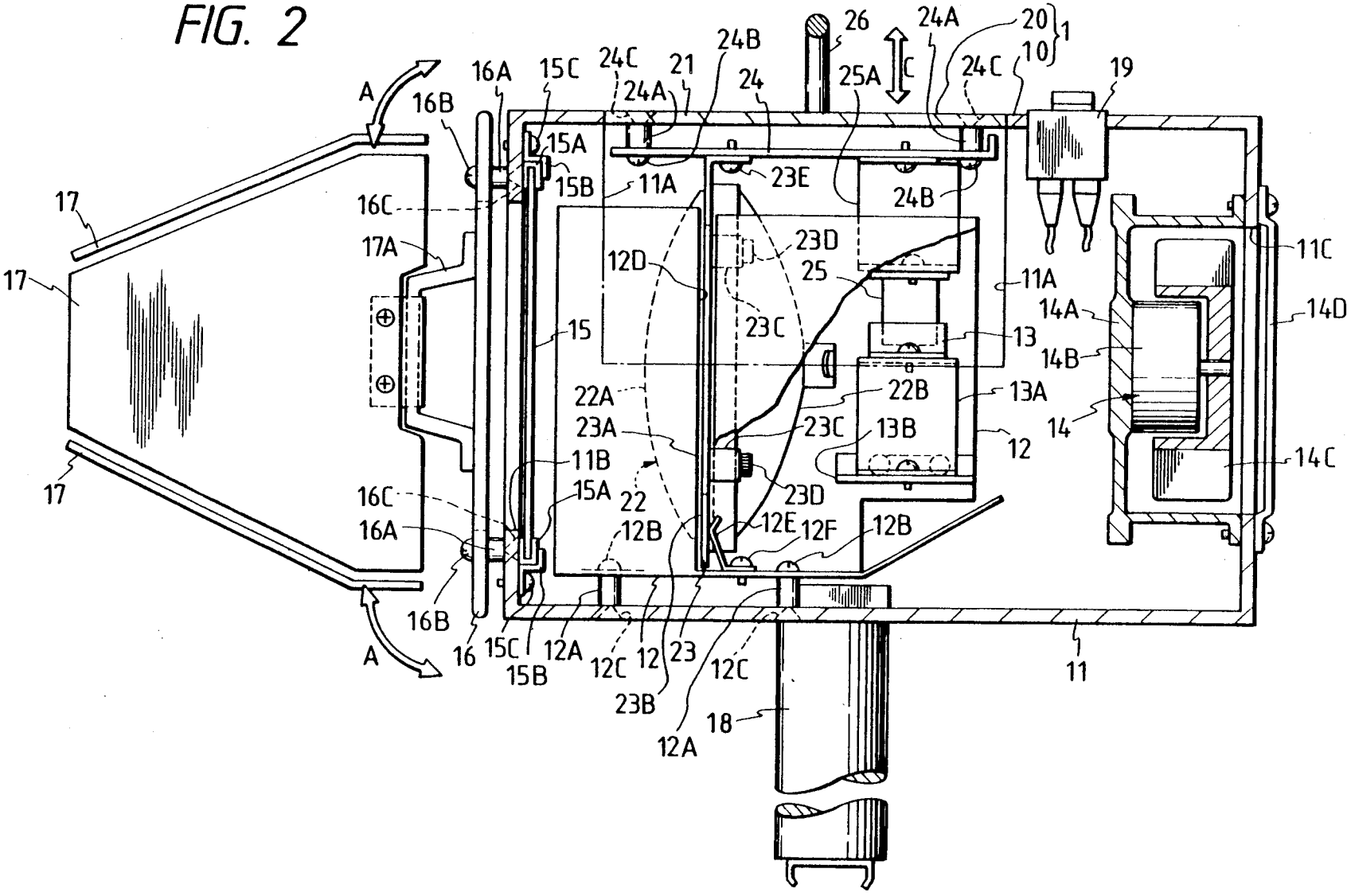
FIG. 2 is a sectional view of the illuminator of FIG. 1.

As shown in FIGS. 1 and 2, the light source unit 20 of the illuminator 1 includes a frame 21, the light source 22, the light source support frames 23 and 24, the supported unit portions 23A and 23B, a power supply connector 25 shaped as a plug, and a handle 26.

The cross section of the frame 21 is U-shaped so that the frame 21 fits the upper portion of the frame 11 so as to seal the opening 11A. The frame 21 is made of the same material as the frame 11.

The light source 22 is attached with the interposed support frames 23 and 24 to the frame 21 by light source holding members 23C and light source holding screws 23D, in at least two positions (four positions in this embodiment). The support frame 23 is attached to the other support frame 24 by screws 23E. The support frame 24 is attached with spacers 24A to the inside of the frame 21 by screws 24B and 24C. The support frames 23 and 24 as well as the unit support 12 are made of a metal, a resin or the like. The light source 22 may be firmly fitted in the support frame 23 in a one-shot manner (e.g. snap-in or press fitted) without using the holding members 23C and the holding screws 23D.

As shown in FIGS. 1 and 2, the light source 22 includes an optical lens 22A, a concave reflection plate 23B and an electric bulb 22C attached in an internal space surrounded by the lens and the reflection plate. The electric bulb 22C is a cold light emission lamp such as a metal vapor lamp hermetically containing a rare-earth metal halide. Mercury and argon are hermetically contained as basic substances in the electric bulb 22C to facilitate arc discharge therein, and a rare-earth element is hermetically contained in the bulb to efficiently generate various kinds of line spectra of good color rendition over the entire range of visible light. The light source 22 is such that the quantity of emitted heat is small even if it has an optimal color temperature of 3,000° to 3,500° K. for picture taking by a photographic or video camera. Although the electric bulb 22C of the light source 22 is formed horizontally narrow or elongate in this embodiment, the form may be elongate or narrow vertically or circular depending on the form, luminance or color temperature of the projected light. In the optical lens 22A of the source 22, a light scattering region is provided in a transparent glass or resin to cause diffused reflection to decrease the quantity of heat from the projected light. The reflection plate 22B of the source 22 is made of a metal, for example, and has a surface reflecting property.

The support frame 23 of the unit 20 is made of a plate having a circular opening in which the source 22 is held. As shown in FIG. 1, the support frame 23 supports the unit portions 23A at both side edges of the frame and the unit portion 23B at the lower edge of the frame. As mentioned above the supported unit portions 23A are inserted into the guide slits 12D of the unit support 12 as shown by a two-dot chain line in FIG. 1, so that the unit 20 is fitted in the illuminator body. As mentioned above, the supported unit portion 23B acts so that the unit 20 fitted in the illuminator body 10 is removably held therein by the retainer 12E provided in the unit support 12. The support frame 23 has heat radiation openings 23F through which heat generated by the light source 22 is transferred so that the heat is discharged out of the body 10 through the heat radiation openings 11D of the frame 11.

The power supply connector 25 is attached with an interposed support member 25A to the support frame 24 of the unit 20 so that the connector is coupled to the power supply connector 13 of the body 10 when the unit 20 is fitted therein. The connector 25 is not coupled to the connector 13 when the unit 20 is not disposed in the illuminator body 10. It should be noted that the connector 25 is coupled to the electrodes of the electric bulb 22C of the light source 22.

A fitting handle 26 is provided on the outside of the frame 21 of the unit 20 so that an operator can easily grasp the handle and easily fit the unit 20 in the body 10 or remove the unit 20 therefrom, as shown by the two-dot chain line B in FIG. 1 and arrows C in FIG. 2.

Since the unit support 12 having the guide slits 12D and the retainer 12E is provided to removably fit the unit 20 in the body 10 and the unit 20 includes the portions 23A and 23B supported by the unit support 12, the light unit 20 can be fitted in the illuminator body or removed therefrom, in a one-shot or one-step manner. I.e. the unit 20 need only be properly placed in the body 10, at which time it is connected and ready to work. For this reason, the replacement of the unit 20 is simplified. For example, when the filament of the electric bulb 22C is disconnected, the unit 20 can be removed from the body 10 in a single step and another unit can be fitted in the body 10 in a single step. Thus, picture taking can be quickly resumed. If the luminance of the source 22, or the form and/or color temperature of the projected light, is not appropriate, the unit 20 can be removed from the body 10 in a one-shot manner and another unit having a light source appropriate in those respects can be fitted in the illuminator body in a one-shot manner to immediately resume the picture taking.

The frame 21 of the unit 20 is provided with a plurality of heat radiation openings 21A, like the frame of the illuminator.

The illuminator 1 may be provided with a fitting stopper to securely fit the unit 20 in the body 10 to prevent the unit from unexpectedly coming loose and falling out of the body 10. For example, the fitting stopper is formed by a hooking member on the body 10 and a hooked member on the unit 20.

The guide slits 12D of the unit support 12 of the body 10 may be slightly tapered to guide and pinch the unit portions 23A of the unit 20. The guide slits 12D may thus function to hold the unit 20.

In the foregoing embodiment, the cold light source lamp is mounted on the light source unit body through the coldlight source support frame. The cold light source lamp is mounted on the cold light source support frame along the outer peripheral portion thereof by three to five L-shaped metal pieces and a plurality of screws.

However, this structure would suffer from a problem such that the cold light source lamp would be unstably mounted due to non-uniform screwing force of the fastening screws. In the case where the lamp would be stably mounted, the lamp would be rattled and fall down during replacement of the light source units. Also, the mounting work would be troublesome due to the fact that the plurality of screws are fastened by using the metal pieces.

A second embodiment of the invention for overcoming the above-noted defects will be described with reference to FIGS. 3 to 8.

A heat insulator member 112 is used to block heat generated in the cold light source 22 so as to prevent the body frame 11 from being heated. Also, the heat insulator member 112 is constructured so as to smoothly guide the light source unit 20 when the light source unit 20 is detachably mounted onto the illuminator body 10. On a bottom of the heat insulator member 112, there are provided positioning members 112D for positioning a bottom face of a cold light source support frame 124 of the light source unit 20 when the light source unit 20 is mounted on the illuminator body 10 and for stably holding the cold light source lamp 22 in place. The positioning members 112D are provided for limiting the cold lamp 22 in the back-and-forth direction (in the illumination direction). The positioning members 112D are made of suitable material having sufficient rigidity, hardness and light weight, such as aluminum, alluminum alloy or synthetic resin.

The electric source connector 13 is connected to an electric source (not shown) through a cable 30A. A switch 30 is provided in an intermediate portion of the cable 30A. This structure is available for preventing undesired motion of the illuminator 1 during the switching operation of the switch 30.

Figure 6:
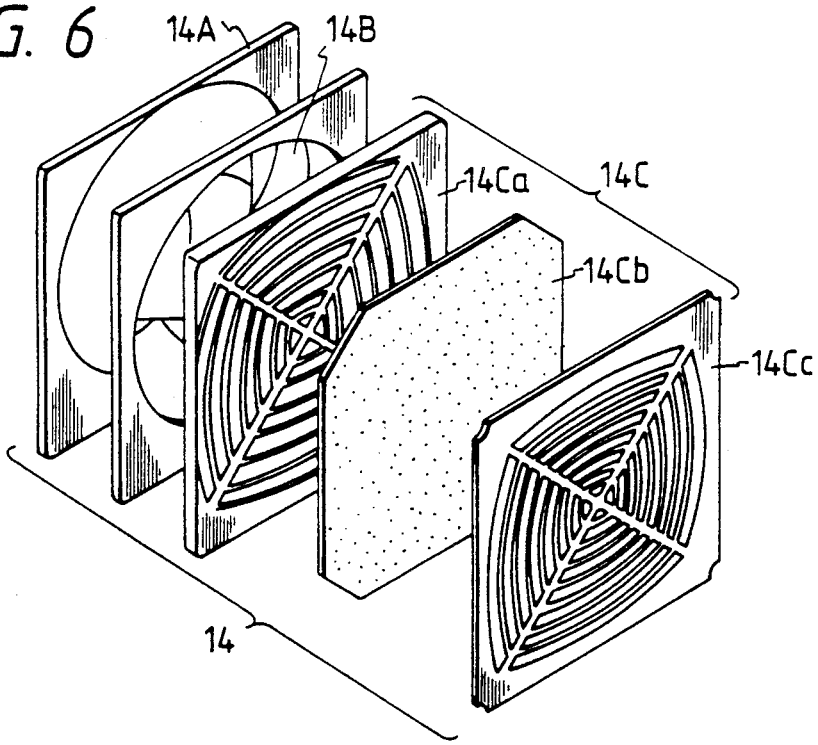
FIG. 6 is an exploded perspective view of the radiator means shown in FIG. 3.

As shown in FIG. 6, a radiator means 14 includes a frame 14A, a drive motor (not shown), a fan 14B mounted on an output shaft of the motor, and a filter assembly 14C. The drive motor of the radiator means 14 is connected directly to the cable 30A. The filter assembly is formed of a laminator composed of a guard member 14Ca, a media member (dust absorption member) 14Cb, and a retainer member 14Cc in order from the inside to the outside of the illuminator 1. The filter assembly serves to absorb dust discharged from the inside to the outside of the illuminator 1, and to keep the non-dust room or operating room clean.

Figure 3:
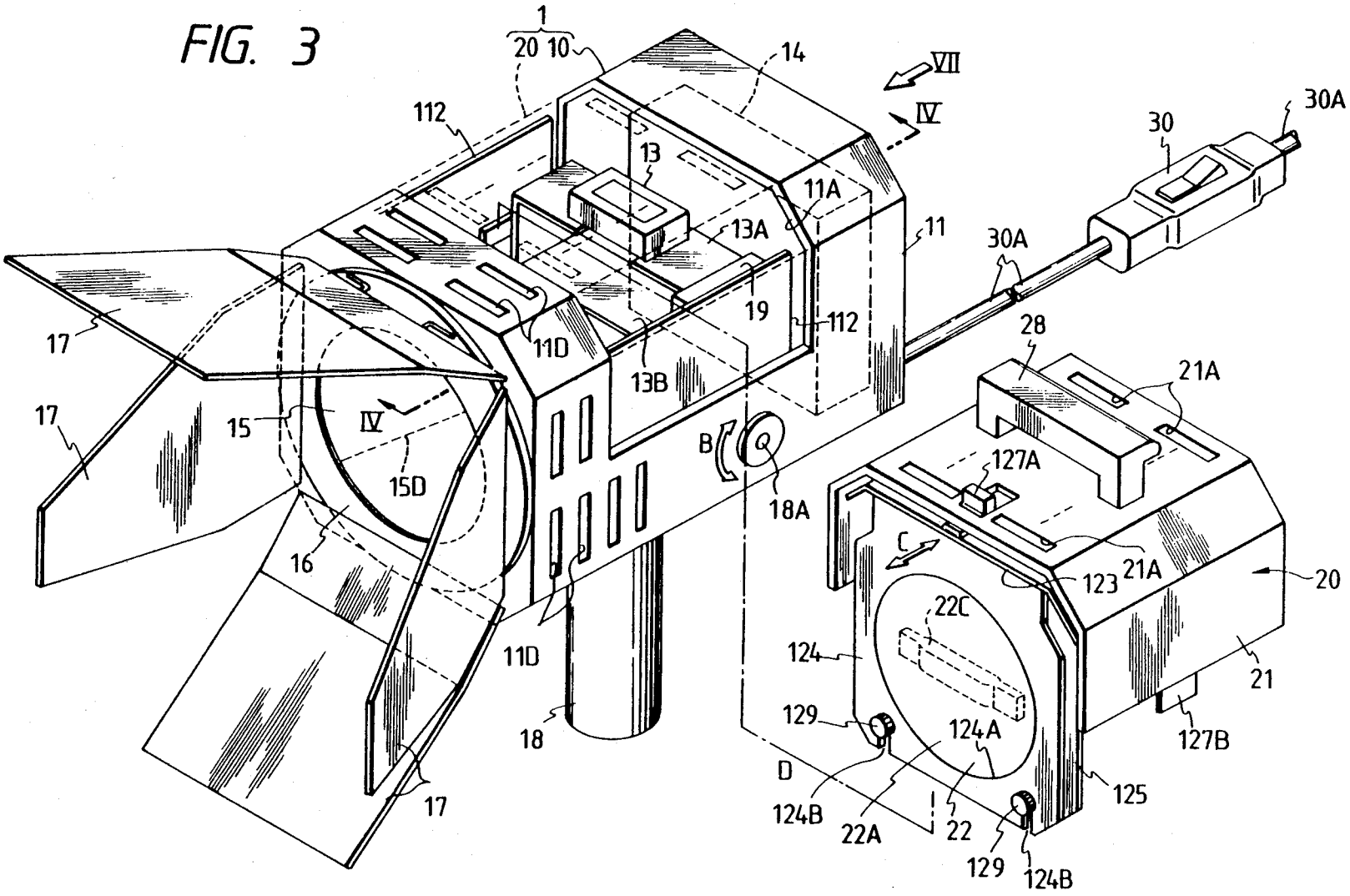
FIG. 3 is a perspective view of an illuminator which is another embodiment of the invention.
Figure 5:
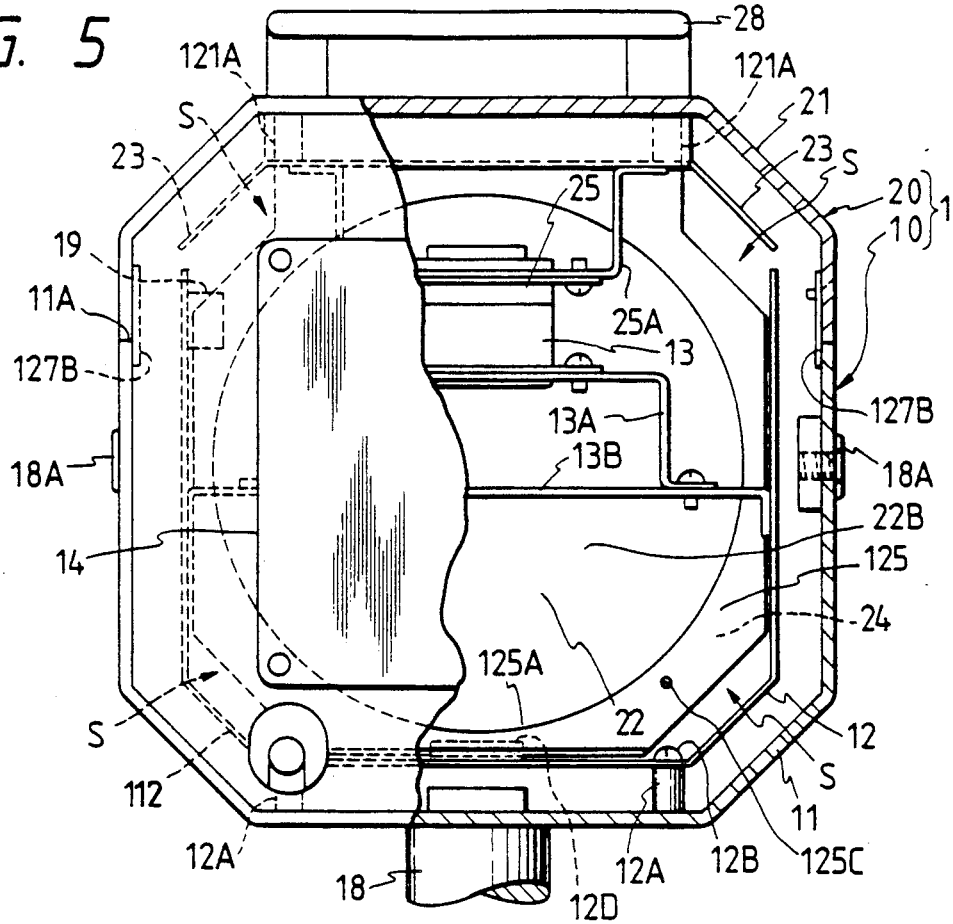
FIG. 5 is a partially fragmentarily sectional view taken along the line V—V of FIG. 3.

As shown in FIGS. 3 and 5, mounting members 18A for supporting the illuminator 1 are provided on opposite side walls of the illumintor body frame 11. The mounting members 18A are to be mounted on an inverted U-shaped member (not shown) for mounting the illuminator 1 on a tripod or the like. As indicated by the arrow B in FIG. 3, the mounting members 18A are used to mount the illuminator 1 to be rotatable as desired.

A thermal protector 19 is disposed in the vicinity of the cold light source lamp 22 inside the heat insulator 112 of the illuminator body 10. The thermal protector 19 serves to detect an inner temperature of the illumintor 1, to interrupt the supply of current to the light source lamp 22 when a predetermined temperature is exceeded, and to automatically turn off the lamp 22. In the case where the radiator means 14 is out of order, the inner temperature of the illuminator 1 reaches a high temperature more than 400° to 500° C. so that cold light source lamp 22 would be damaged due to the high temperature. Thus, it is preferable to provide the thermal protector in the illuminator 1. Also, it is possible to provide the thermal protector 19 on the light source unit 20 side.

A mount stop member 127A is mounted on an upper wall of the frame 21 and mount stop members 27B are mounted on opposite side walls of the unit frame 21. The mount stop members 27B serves to prevent the light source unit 20 from moving relative to the illumintor body 10 when the light source unit 20 is mounted on the illuminator body 10. The mount stop member 27A may be moved in a direction indicated by the arrow C in FIG. 3, so that the movement of the light source unit 20 relative to the illumintor is prevented when the unit 20 is mounted on the illuminator 1.

The cold light source lamp 22 has an optical lens 22A and a reflector 22B that are coupled along their peripheral portions to define therebetween a central cavity in which a bulb 22C is disposed. The lamp 22 is electrically connected to the electric source connector 25.

A light source support frame 124 is composed of a plate-like member having a circular through hole 124A in its central portion. The through hole 24A is somewhat smaller in size than the peripheral connected portion between the optical lens 22A and the reflector 22B. In other words, the cold light source lamp support frame 124 is brought into contact with a surface of the peripheral portion of the cold light source lamp 22 along the peripheral portion. The cold light source lamp support frame 124 is formed in an octagonal shape and a substantially U-shape confronting with the U-shape of the heat insulator member 112. The cold light source lamp support frame 124 serves to limit the mounting portion of the cold light source lamp 22 and to clamp and hold the lamp 22. The lamp support frame 124 is smoothly guided by the heat insulator member 112 of the illuminator body 10. The support frame 124 is also used as a guide for attaching the light source unit 20 to the illuminator body 10. Under the condition that the light source unit 20 is mounted on the illuminator 10, the corner portions of the light source support frame 124 are larger in size than those of the light insulator member 112 of the illuminator body 10 so as to form spaces S as shown in FIG. 5. These spaces S serve to enhance the heat radiation effect.

Figure 4:
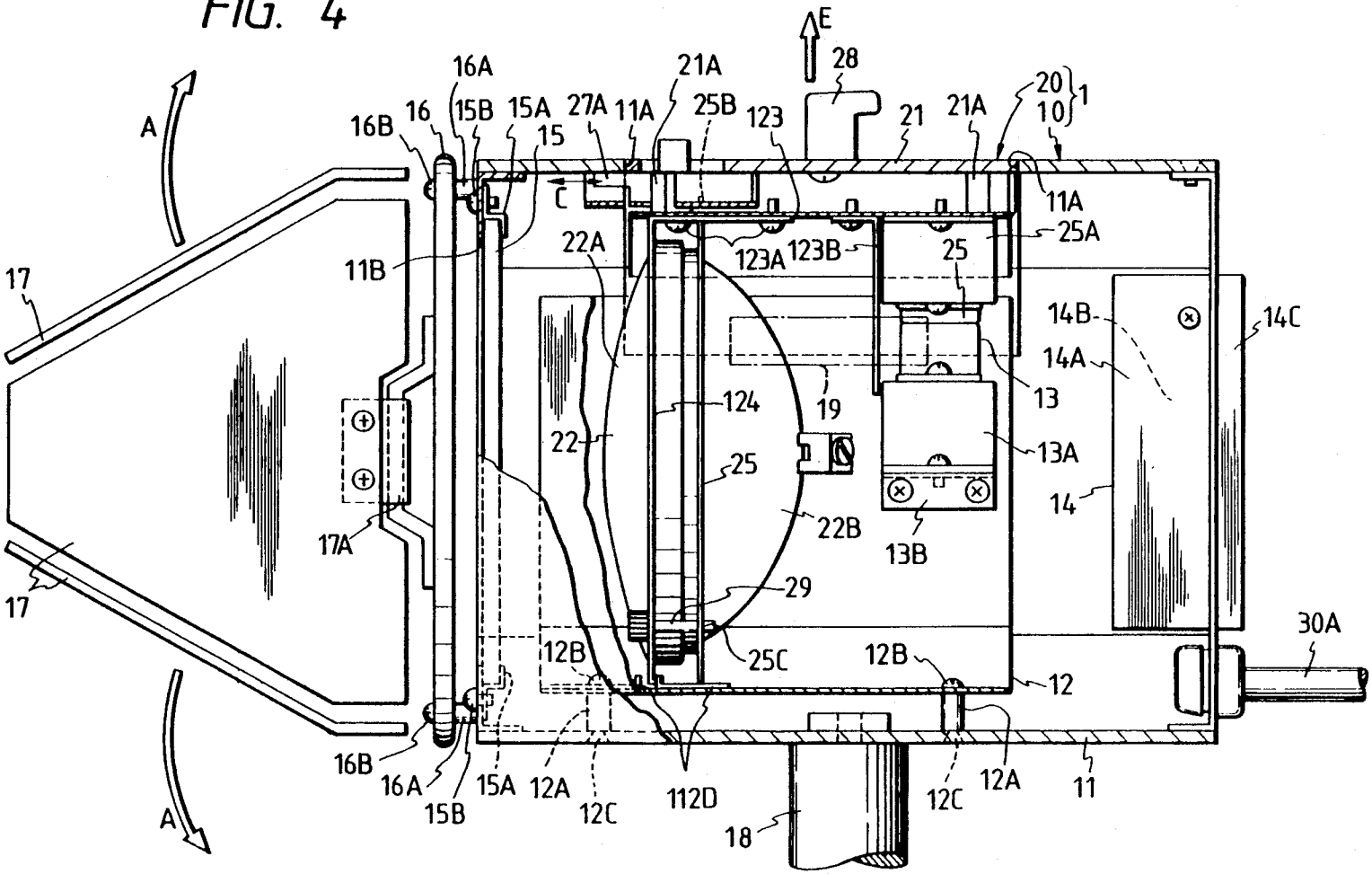
FIG. 4 is a sectional view of the illuminator shown in FIG. 3, taken along the line IV—IV.

The light source support frame 124 is mounted on the insulator member 123 and is further attached to the unit body frame 21 through insulator 123. The support frame 124 and the insulator member 123 are mounted by screws 123A as shown in FIG. 4. The insulator member 123 is mounted through spacers 123A and screws to the unit body frame 21. The support frame 124 is made of material having a suitable hardness and durability against a high temperature, such as stainless steel, synthetic resin or the like. The insulator 123 is made of the same material as that of the insulator member 112.

A cold light source lamp retainer frame 125 has at its upper side two projections 125B and at its lower side two screw holes 125C. The projections 125B may be inserted into through holes (not shown) formed in the lamp support frame 124 and the heat insulator member 123. Screws 129 are inserted at one ends to the screw holes 125C. The other ends of the screws 129 are provided from a back side to a front side of the lamp support frame 124 through U-grooves 124B formed at the lower edge of the lamp support frame 124. Namely, the lamp retainer frame 125 is constructed so as to clamp the cold light source lamp 22 interposed between the support frame 124 and the retainer plate 125. The through holes of the projections 125B, the screws 129, the screw holes 125C, and the grooves 124B are provided for keeping the condition that the cold light source lamp 22 is clamped by the support frame 124 and the retainer frame 125 to form retainer means.

The operation for mounting the lamp 22 in the light source unit 20 will be explained.

Figure 8:
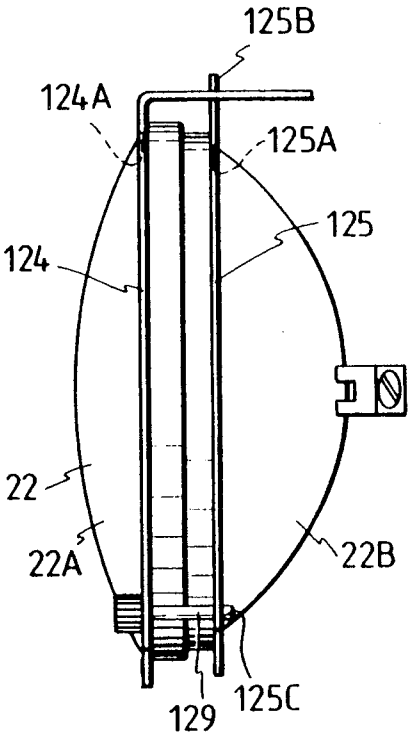
FIG. 8 is a side elevational view showing the light source unit shown in FIG. 3.
Figure 7:
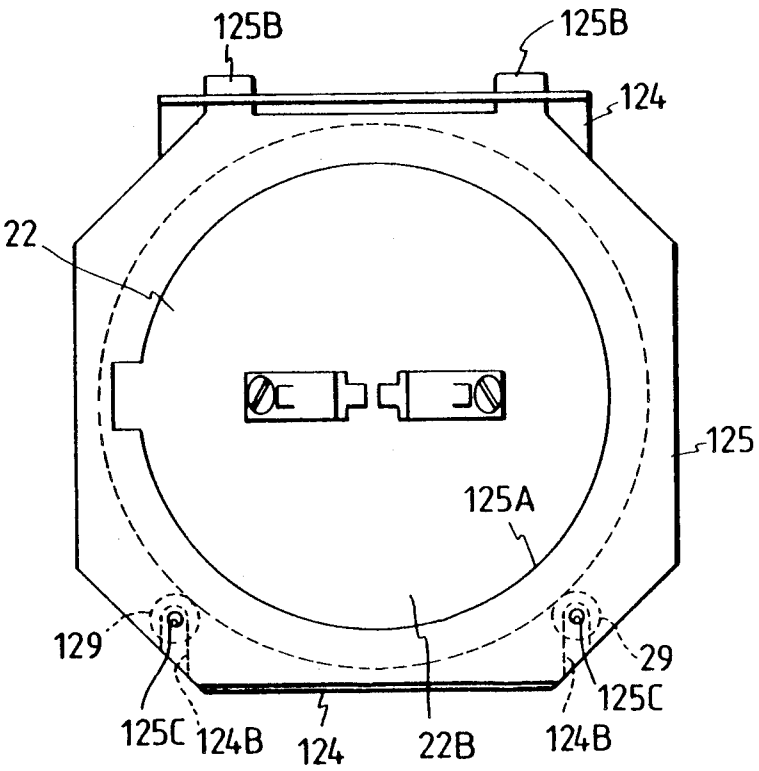
FIG. 7 is a frontal view showing the light source unit shown in FIG. 3.

The peripheral portion of the cold light source 22 is brought into contact with the peripheral portion around the through hole 124A of the support frame 124 of the light source unit 20 as shown in FIGS. 7 and 8.

Subsequently, the projections 125B of the retainer frame 125 are inserted into the through holes formed in the support frame 124 and the heat insulator member 123, respectively. The peripheral portion for supporting the lamp 22 is brought into contact with the pheripheral portion of the through hole 125A of the retainer frame 125.

Then, the screws 129 are used so as to hold the lamp 22 between the support frame 124 and the lamp retainer frame 125. Since in this embodiment two screws 129 are used, it is possible to achieve the mounting of the lamp 22 onto the light source unit 20 in a short period of time only by fastening two parts.

The removal operation may be carried out in the opposite order to the mounting steps.

Thus, according to the present invention, since most of the peripheral portion of the cold light source lamp 22 may be uniformly supported by the support frame 124 and the retainer frame 125, it is possible to stably hold the lamp 22 on the light source unit 20. Also, the fastening parts are limited to a minimum level, so that the mounting work for mounting the lamp to the light source unit 20 may be facilitated.

The insulator member 123B is mounted between the electric connector 25 and the cold light lamp 22 as shown in FIG. 4. Thus, the insulator member 123B is used to prevent the connector 25 from being damaged due to heat generated in the lamp 22. The insulator material 123B is mounted on the insulator member 123.

The present invention greatly simplifies replacement of the light source of an illuminator by enabling one-step removal and insertion of a light source unit. The invention is not confined to the above-described embodiment but may be embodied or practiced in various other ways without departing from the spirit or essential character of the invention. For example, the present invention may be an illuminator in which a light source unit with a plurality of light sources, or a plurality of light source units, are fitted in the body of the illuminator. The present invention may be applied not only to picture taking in medical and biological applications, but also in other fields.

What is claimed is:

1. An illuminator comprising:

a frame having an opening defined therein; and a light source unit for removable mounting via said opening in said frame in an operative position in said frame, said light source unit including a light source and mounting portions attached thereto such that in said operative position, said light source is pointed in a direction perpendicular to the direction in which said light source unit was moved when mounted;

wherein said frame has a unit support member mounted therein for removably supporting said mounting portions of said light source unit when said light source unit is placed in said operative position in said frame, said unit support member having guide slits which guide said light source unit and a retainer member which retains said light source unit.

2. An illuminator according to claim 1, wherein said light source is a cold-light lamp.

3. An illuminator according to claim 2, wherein said light source is a metal vapor lamp hermetically containing a rare-earth metal halide.

4. An illuminator according to claim 1, wherein said light source unit further comprises a plate-like member for supporting said light source in said light source unit, said mounting portions are formed as plate-like extensions to said plate-like member, and said unit support member has guide slits formed therein for guiding said mounting portions to position said light source unit in said operative position.

5. An illuminator according to claim 4, wherein said unit support member further comprises means for releasably retaining said mounting portions in said guide slits when said light source unit is in said operative position.

6. An illuminator according to claim 1, wherein said illuminator further comprises a power supply for powering said light source, said light source unit includes a power supply connector connected to said light source, and said illuminator further comprises means for connecting said power supply connector of said light source unit, to said power supply in response to positioning of said light source unit in said operative position.

7. An illuminator according to claim 1, wherein said light source unit further includes a lamp support frame for supporting said light source in place and a lamp retainer frame for retaining said light source supported by said lamp support frame, thereby holding said light source between said lamp support frame and said lamp retainer.

8. An illuminator according to claim 7, wherein said light source unit further includes a screw means for detachably mounting said light source between said lamp support frame and said lamp retainer frame.

9. An illuminator according to claim 8, wherein said light source unit further comprises a plate-like member for supporting said lamp support frame.

10. An illuminator according to claim 9, wherein said plate-like member is provided with looking means for stopping said lamp support frame onto said plate-like member when said light source unit is in said operative position.

11. An illuminator according to claim 7, wherein said lamp support frame and said lamp retainer are made of plate-like members having openings somewhat smaller than an outer diameter of said light source.

12. An illuminator comprising:

a frame having an opening defined therein; and a light source unit for removable mounting via said opening in said frame in an operative position in said frame, said light source unit including a light source and mounting portions attached thereto;

wherein said frame has a unit support member mounted therein for removably supporting said mounting portions of said light source unit when said light source unit is placed in said operative position in said frame; and wherein said light source unit further comprises a plate-like member for supporting said light source in said light source unit, said mounting portions are formed as plate-like extensions to plate-like member, and said unit support member has guide slits formed therein for guiding said mounting portions to position said light source unit in said operative position.

13. An illuminator according to claim 12, wherein said unit support member further comprises means for releasably retaining said mounting portions in said guide slits when said light source unit is in said operative position.

14. An illuminator comprising:

a frame having an opening defined therein; and a light source unit for removalbe mounting via said opening in said frame in an operative position in said frame, said light source unit including a light source and mounting portions attached thereto;

wherein said frame has a unit support member having guide slits which guide said light source unit mounted therein for removably supporting said mounting portions of said light source unit when said light source unit is placed in said operative position in said frame; and wherein said light source unit further includes a lamp support frame for supporting said light source in place and a lamp retainer frame for retaining said light source supported by said lamp support frame, thereby holding said light source between said lamp support frame and said lamp retainer, and wherein said light source unit further includes a screw means for detachably mounting said light source between said lamp support frame and said lamp retainer frame.

15. An illuminator according to claim 14, wherein said light source unit further comprises a plate-like member for supporting said lamp support frame.

16. An illuminator according to claim 15, wherein said plate-like member is provided with locking means for stopping said lamp support frame onto said plate-like member when said light source unit is in said operative position.

17. An illuminator according to claim 14, wherein said lamp support frame and said lamp retainer are made of plate-like members having openings somewhat smaller than an outer diameter of said light source.

* * * * *